United States Patent [19]

Sprague

[11] 4,078,539

[45] Mar. 14, 1978

[54] ROCK GRIPPER ASSEMBLY

[76] Inventor: Charles R. Sprague, 142 Fredricksburg Way, Vancouver, Wash. 98664

[21] Appl. No.: 757,967

[22] Filed: Jan. 10, 1977

[51] Int. Cl.[2] ..... B28P 7/04

[52] U.S. Cl. ..... 125/35; 51/216 R; 125/13 R; 269/156; 279/106

[58] Field of Search ..... 51/216 A, 216 R; 125/13 R, 35; 269/156; 279/106

[56] References Cited

U.S. PATENT DOCUMENTS

| | | | |
|---|---|---|---|
| 297,981 | 5/1884 | Francis | 269/156 X |
| 1,022,761 | 4/1912 | Stvanek | 279/106 |
| 2,436,004 | 2/1948 | Hall | 51/216 H |
| 3,103,922 | 9/1963 | Nelson | 125/13 R |

*Primary Examiner*—Harold D. Whitehead

*Attorney, Agent, or Firm*—Kolisch, Hartwell, Dickinson & Stuart

[57] ABSTRACT

A chuck assembly for gripping and holding objects including a base, a face plate rotatably mounted on the base, and a plurality of arms pivotally connected to and extending outwardly from the face plate for swinging toward and away from each other. A threaded tube is secured to the face plate and a nut on the tube is operable to urge the face plate into frictional engagement with the base to secure it in a selected position. A threaded rod extends through the tube and has a semi-spherical washer pivotally mounted thereon. Connecting members extending inwardly from the arms engage portions of the washer. A nut on the threaded rod is operable to draw the washer toward the face plate to swing the arms toward each other. During swinging of the arms toward each other the washer may pivot on the rod to permit the arms to swing toward each other at different rates to grip and hold an asymmetrical object therebetween.

6 Claims, 4 Drawing Figures

ROCK GRIPPER ASSEMBLY

BACKGROUND AND SUMMARY OF THE INVENTION

This invention relates to a chuck assembly for gripping and holding an object.

In the past, various styles of chuck assemblies have been devised for gripping and holding objects, but for the most part these are not adapted to gripping and holding irregularly shaped objects, with the object substantially centered on a selected datum line.

A general object of the present invention is to provide a novel chuck assembly which is economically constructed and simple to operate for selectively gripping and holding objects, some of which may be asymmetrical or irregular in shape.

More specifically, an object of the present invention is to provide a novel chuck assembly which includes a face plate mounted for rotation about an axis on a base, means for locking the face plate in a selected position, a plurality of elongate arms projecting outwardly in a substantially common direction from the face plate and being pivotally connected thereto for swinging toward and away from each other, and means for swinging the arms toward each other. The means for swinging the arms toward each other includes a semi-spherical washer pivotally mounted on a member shiftable toward and away from the face plate, whereby the washer may swing to different angular positions relative to the member to permit each arm to swing inwardly toward the other arms at a rate different from the swinging rate of the other arms to permit gripping of irregularly shaped articles.

A still further object of the present invention is to provide such a novel chuck assembly wherein an object held in the chuck may be held in a first orientation upon locking of the face plate, and then may be rotated with the face plate to a second position and relocked in this second orientation without the need for releasing the article from the chuck assembly. With such construction, an object held in the chuck may be rotated about an axis extending substantially normal to the face plate of the chuck assembly with a point on the object being rotated in a plane substantially paralleling the face plate.

DRAWINGS

These and other objects and advantages will become more fully apparent as the following description is read in conjunction with the drawings wherein.

DETAILED DESCRIPTION OF A PREFERRED EMBODIMENT OF THE INVENTION

Figure 1:
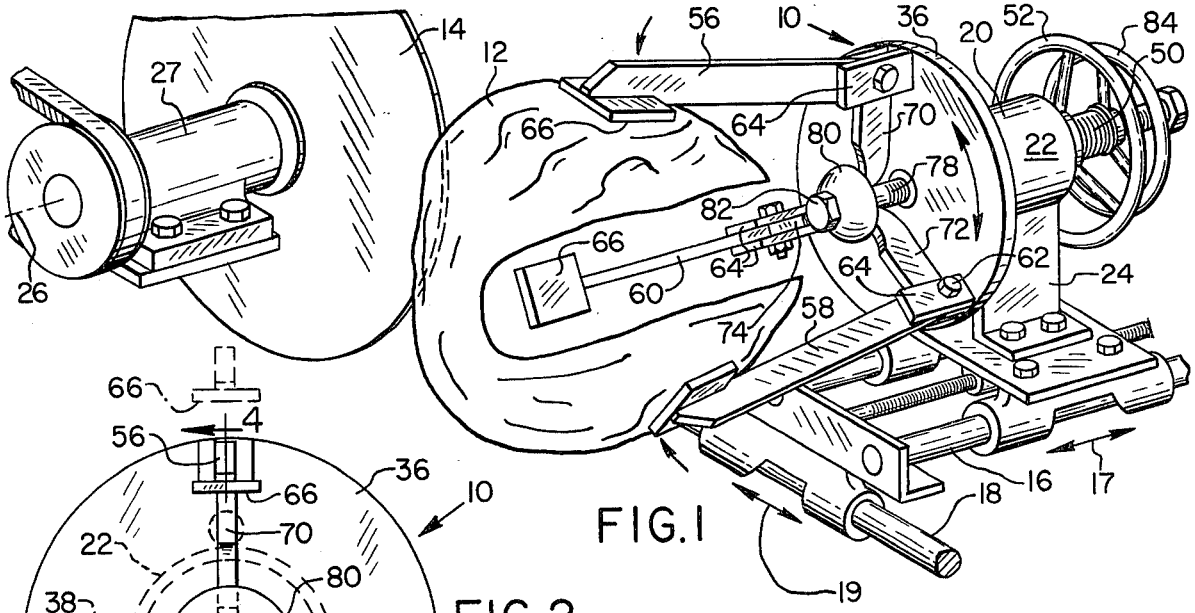
FIG. 1 is a perspective view of a chuck assembly according to an embodiment of the invention holding an irregular object, such as a rock, for cutting by a saw.
Figure 2:
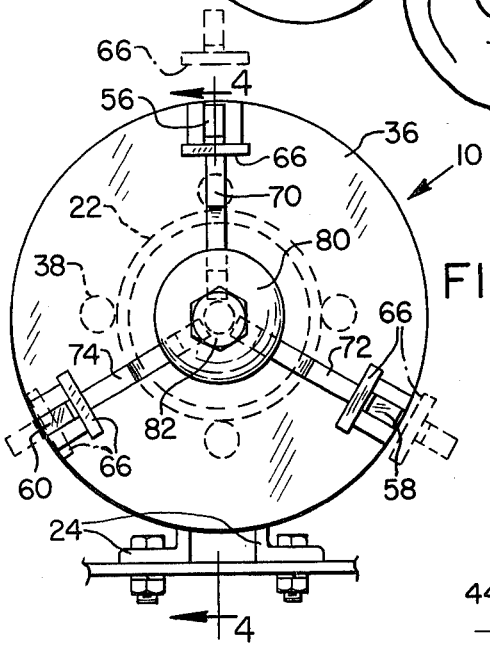
FIG. 2 is an enlarged front end view of the chuck assembly.

At 10 is indicated generally a chuck assembly constructed according to an embodiment of the invention. As illustrated in FIG. 1, the chuck assembly is adapted to hold a rock 12 in place for cutting by a power-rotated saw blade 14. The chuck assembly is mounted on rails

16 for shifting toward and away from the saw blade in the directions of arrow 17, and on rails 18 for shifting movement along a path paralleling the upright planes occupied by opposite faces of saw blade 14 as indicated by arrow 19.

Figure 4:
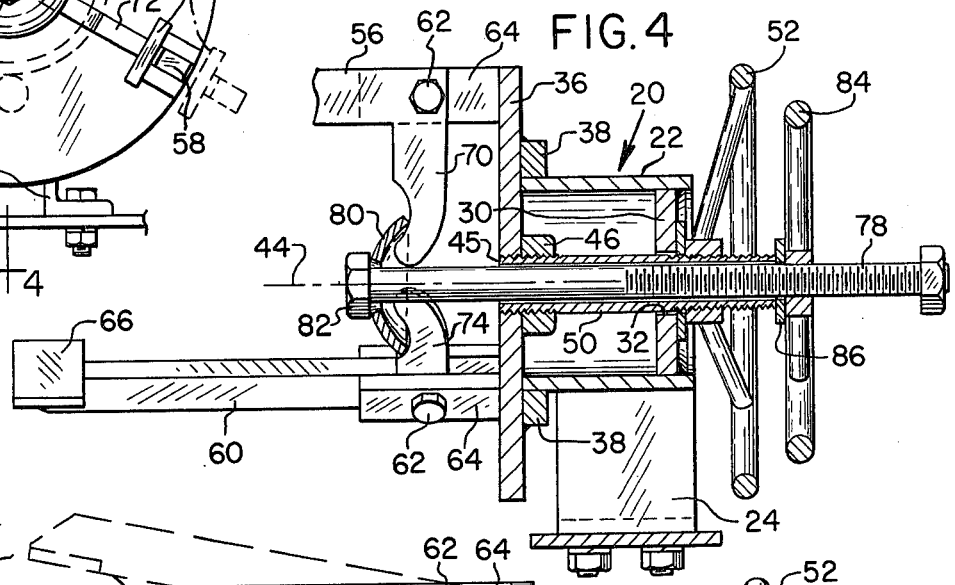
FIG. 4 is a cross-sectional view of the chuck assembly taken generally along the line 4—4 in FIG. 2.
Figure 3:
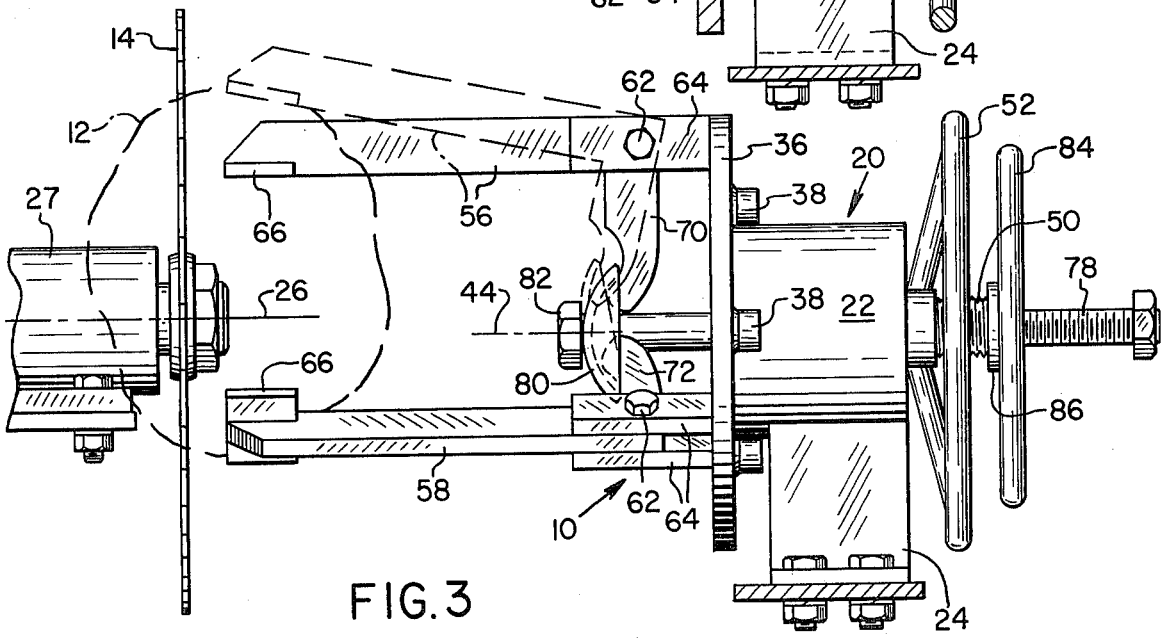
FIG. 3 is a side elevation view of the chuck assembly.

Referring to FIG. 3, the chuck assembly includes a base 20 which is mounted on rails 16. The base includes a cylindrical housing 22 supported on a pair of angles 24. The central axis of housing 22 extends substantially horizontally in the apparatus and parallel to axis 26 of shaft 27 mounting saw 14. As is best seen in FIG. 4, a circular plate 30 is secured, as by welding, within one end of housing 22. A bore 32 extends through the center of plate 30.

A face plate 36 is loosely mounted on housing 22 by a plurality of dogs, or lugs, 38 secured, as by welding, to what is referred to as the rear face of plate 36. There would be at least three lugs 38 and they would be spaced apart so as to rest loosely on and support face plate 36 for rotation on one end of housing 22. The face plate thus is mounted for rotation on the base about a central axis indicated at 44 which is substantially normal, or perpendicular, to face plate 36, and saw blade 14, and substantially parallels axis 26 of the saw blade.

A threaded bore 45 extends through the center of plate 36. An elongate tube 50 which has a threaded exterior surface is screwed into bore 45 and extends outwardly through bore 32 in plate 30. A lock nut 46 is screwed on tube 50 and against plate 36 to lock the tube and plate together. A hand wheel, or nut means, 52 is screwed onto tube 50. Tightening of hand wheel 52 on tube 50 draws face plate 36 into frictional engagement with an end of housing 22 to lock the face plate in a selected position. Loosening of the hand wheel permits the face plate to be rotated about axis 44 to any desired position.

In the illustrated embodiment of the invention, three elongate, laterally spaced arms 56, 58, 60 are pivotally connected as by bolts 62, adjacent one set of their ends to lugs 64 secured to and extending outwardly from a face of face plate 36. Arms 56, 58, 60 extend outwardly in a substantially common direction from face plate 36 and are spaced about axis 44. Each arm has a gripping pad 66 secured thereto adjacent its end farthest from face plate 36.

Elongate operating legs, or members, 70, 72, 74 are secured to and project substantially normally inwardly toward center line 44 from arms 56, 58, 60, respectively.

An elongate threaded rod 78 having thereon a head 82 with a flat inner face extends slidably through tube 50. A formed semi-spherical washer 80 having a convex outer face and a concave inner face is pivotally, or tiltably, mounted on one end of rod 78, its convex face adjacent the flat inner surface of head 82.

A second hand wheel, or nut means, 84 is screwed onto rod 78 adjacent the right end of tube 50 as illustrated in FIGS. 1, 3, and 4. A washer 86 is interposed between hand wheel 84 and the end of tube 50.

The innermost ends of legs 70, 72, 74 engage circumferentially spaced portions of washer 80 on its concave face. As hand wheel 84 is screwed in one direction on rod 78, the rod is shifted in the direction of its longitudinal axis to the right in FIGS. 1, 3, and 4, causing washer 80 to bear against the inner ends of legs 70, 72, 74 which, in turn, swing the outer ends of arms 56, 58, 60 inwardly toward center line 44 and toward each other. Since washer 80 is swingably mounted on rod 78, should one of the arms engage a surface of an object to be held therebetween, it may stop moving inwardly toward the other arms while the other arms are continually drawn toward center line 44. As this occurs, the portion of washer 80 operatively connected to the arm which is stopped by engaging the surface of the object substantially ceases or slows its movement while other portions of the washer continue to be moved inwardly toward face plate 36 and thus continue to swing their arms inwardly toward center line 44 as hand wheel 84 is operated. Thus, it will be seen that with washer 80 being swingably mounted on rod 78, portions thereof may move at different rates toward the face place to produce differential rates of swinging of the arms associated with the various portions of the washer as they are shifted inwardly toward center line 44.

Describing operation of the apparatus, hand wheel 84 first is loosened on rod 78 to permit swinging of arms 56, 58, 60 away from each other to a position where they can be spaced far enough apart to receive the article to be gripped therebetween. After the article is inserted between the arms, hand wheel 84 is screwed on rod 78 to shift washer 80 toward face plate 36. As it is shifted toward the face plate it swings the elongate arms toward each other and toward center line 44 to engage opposed sides of the article to be gripped. Should one of the arms engage a surface of the article before other ones of the arms, the swinging mounting of washer 80 permits that arm to slow in its movement toward the center line or stop at that position. Continued operation of hand wheel 84 causes rod 78 and other portions of washer 80 to advance toward face plate 36 to swing the others of the arms inwardly against surfaces of the object. When the arms are fully tightened against the object, it is held therein. With the hand wheel 52 locking face plate 36 against housing 22, the object is held for working, such as being drawn along rails 18 past saw blade 14.

As it often the case, the saw blade might not be large enough to cut completely through the object, and thus it will make a first pass through the object, and then the object must be turned 180° about axis 44 to produce a cut in the other side to saw completely through the object. This is simply and effectively accomplished by merely loosening hand wheel 52, which releases face plate 36 from its frictional engagement with housing 22. The face plate, arms, and objects held by the arms then are rotated 180° about central axis 44 and then relocked in position by tightening up hand wheel 52. The object then is positioned for producing the second cut. Throughout such turning of the object, the object is held firmly by the arms, since there is no release of hand wheel 84 or the arms from the object.

While a preferred embodiment of the invention has been described herein, it should be apparent to those skilled in the art that variations and modifications are possible without departing from the spirit of the invention.

I claim:

1. A chuck assembly for gripping and holding an object comprising a base, a face plate mounted on said base for rotation about an axis extending substantially normal to said face plate, a tube connected to said face plate, at least a pair of laterally spaced elongate arms pivotally connected at one set of their ends to said face plate and extending outwardly therefrom in a substantially common direction, said arms being swingable toward and away from each other, and operating means operable to swing said arms toward and away from each other at differing rates to permit gripping and holding an asymmetrical object therebetween, said operating means including an elongate threaded rod having a heat at one end and extending axially through said tube, a semi-spherical washer having a convex outer face and a concave inner face, which washer is tiltably mounted on said rod with its convex outer face adjacent said rod head for swinging to various angular positions relative to the longitudinal axis of said rod, nut means screwed onto said threaded rod for shifting said rod axially through said tube, and means operatively connecting each of said arms to selected portions of the concave inner face of said washer for producing swinging of said arms toward each other on shifting of said rod and washer in one direction relative to said face plate, with each arm being swung toward said other arms at a rate corresponding to the rate of movement of the portion of said washer face to which the arm is operatively connected.

2. The chuck assembly of claim 1, further comprises locking means for locking said face plate in a selected position.

3. The chuck assembly of claim 2, wherein said locking means comprises said tube connected to said face plate, said tube having external threads, and nut means screwed on said threaded tube operable to urge said face plate into frictional engagement with said base to hold the same in a selected position.

4. The chuck assembly of claim 3, wherein said threaded tube comprises an elongate tube, and said operating means comprises an elongate threaded rod extending axially therethrough, said operating member being mounted on said rod adjacent one end thereof operatively connected to said arms for producing swinging of said arms toward each other on shifting of said rod and operating member in one direction relative to said face plate, and second nut means on said threaded rod operable on operation to produce shifting of said rod and operating member in said one direction.

5. A chuck assembly for gripping and holding an object comprising, a base, a face plate mounted on said base for rotation about an axis extending substantially normal to said face plate, a threaded tube connected to said face plate and nut means thereon operable to urge said face plate into frictional engagement with said base to lock said face plate in a selected position relative to said base, at least a pair of laterally spaced elongate arms pivotally connected at one set of their ends to said face plate and extending outwardly therefrom in a substantially common direction, said arms being swingable toward and away from each other, end operating means operable to swing said arms toward each other at differing rates to permit gripping and holding an asymmetrical object therebetween, said operating means including an elongate threaded rod having a head at one end and extending axially through said tube, a semi-spherical washer having a convex outer face and a concave inner face, which washer is tiltably mounted on said rod with its convex outer face adjacent said rod head for swinging to various angular positions relative to the longitudinal axis of said rod, nut means screwed into said threaded rod for shifting said rod axially through said tube, and means operatively connecting each of said arms to selected portions of the concave inner face of said washer for producing swinging of said arms toward each other on shifting of said rod and washer in one direction relative to said face plate, with each arm being swung toward said other arms at a rate corresponding to the rate of movement of the portion of said washer face to which the arm is operatively connected.

6. The chuck assembly of claim 5, wherein a screw means comprises a hand wheel.

* * * * *

UNITED STATES PATENT AND TRADEMARK OFFICE

CERTIFICATE OF CORRECTION

PATENT NO. : 4,078,539

DATED : March 14, 1978

INVENTOR(S) : Charles R. Sprague

It is certified that error appears in the above-identified patent and that said Letters Patent are hereby corrected as shown below:

In column 3, line 38, delete "it" and insert therefor —is—;

In column 3, line 58, delete "I claim:" and insert therefor —What is claimed is:—;

In column 4, line 7, delete "heat" and insert therefor —head—;

In column 4, line 25, after "claim 1," insert —which—;

In column 4, line 59, delete "end" and insert therefor —and—.

Signed and Sealed this

*Twenty-fourth* Day of *October 1978*

[SEAL]

*Attest:*

RUTH C. MASON
*Attesting Officer*

DONALD W. BANNER
*Commissioner of Patents and Trademarks*